US009362064B2

(12) United States Patent
Gottschalk

(10) Patent No.: US 9,362,064 B2
(45) Date of Patent: Jun. 7, 2016

(54) ELECTRICAL SWITCHING APPARATUS AND OPENING ASSEMBLY HAVING AN ENGAGEMENT LUG

(71) Applicant: EATON CORPORATION, Cleveland, OH (US)

(72) Inventor: Andrew Lawrence Gottschalk, Monaca, PA (US)

(73) Assignee: EATON CORPORATION, Cleveland, OH (US)

( * ) Notice: Subject to any disclaimer, the term of this patent is extended or adjusted under 35 U.S.C. 154(b) by 28 days.

(21) Appl. No.: 14/548,455

(22) Filed: Nov. 20, 2014

(65) Prior Publication Data

US 2015/0144474 A1 May 28, 2015

Related U.S. Application Data

(60) Provisional application No. 61/909,460, filed on Nov. 27, 2013.

(51) Int. Cl.

| | |
|---|---|
| ***H01H 5/00*** | (2006.01) |
| ***H01H 3/30*** | (2006.01) |
| ***H01H 3/38*** | (2006.01) |
| ***H01H 3/42*** | (2006.01) |
| ***H01H 71/50*** | (2006.01) |

(52) U.S. Cl.

CPC ..... *H01H 3/3031* (2013.01); *H01H 3/38* (2013.01); *H01H 3/42* (2013.01); *H01H 71/505* (2013.01); *H01H 2235/00* (2013.01)

(58) Field of Classification Search

CPC ..... H01H 3/30; H01H 3/38; H01H 3/3015; H01H 3/3031; H01H 71/505

USPC ..... 200/400, 468, 470–472; 335/171

See application file for complete search history.

(56) References Cited

U.S. PATENT DOCUMENTS

| | | | | |
|---|---|---|---|---|
| 3,835,275 | A | 9/1974 | Preuss | |
| 5,924,554 | A * | 7/1999 | Dosmo | H01H 77/104 200/400 |
| 7,528,336 | B2 * | 5/2009 | Hashimoto | H01H 33/40 200/400 |
| 8,063,328 | B2 * | 11/2011 | Gottschalk | H01H 3/3015 200/400 |
| 8,642,907 | B2 * | 2/2014 | Slepian | H01H 71/50 200/400 |
| 2013/0161169 | A1 | 6/2013 | Gottschalk et al. | |
| 2013/0199910 | A1 | 8/2013 | Slepian et al. | |

OTHER PUBLICATIONS

European Patent Office, "International Search Report and Written Opinion", Feb. 6, 2015, 11 pp.

* cited by examiner

*Primary Examiner* — Vanessa Girardi

(74) *Attorney, Agent, or Firm* — Eckert Seamans Cherin & Mellott, LLC; Brij K. Agarwal; Grant E. Coffield

(57) ABSTRACT

An opening assembly is provided for an electrical switching apparatus having a housing, separable contacts enclosed by the housing, and an operating mechanism for opening and closing the separable contacts. The operating mechanism includes a poleshaft. The opening assembly includes a spring link comprising a first portion structured to be pivotably coupled to the poleshaft, and a second portion disposed generally opposite of the first portion. A number of opening springs each include a stationary end coupled to the housing, and a movable end coupled to the second portion of the spring link. The spring link is movable between an open position, wherein the opening springs bias the spring link and poleshaft to maintain full separation of the separable contacts, and a closed position, wherein the opening springs either do not bias the poleshaft or bias the poleshaft with a low level of torque.

11 Claims, 10 Drawing Sheets

ELECTRICAL SWITCHING APPARATUS AND OPENING ASSEMBLY HAVING AN ENGAGEMENT LUG

CROSS-REFERENCE TO RELATED APPLICATION

The instant application claims priority from U.S. Provisional Patent Application Ser. No. 61/909,460 filed Nov. 27, 2013, the disclosures of which are incorporated herein by reference.

BACKGROUND

1. Field

The disclosed concept relates generally to electrical switching apparatus and, more particularly, to electrical switching apparatus, such as circuit breakers. The disclosed concept also relates to opening assemblies for electrical switching apparatus.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contact assemblies to interrupt the flow of current through the conductors of an electrical system in response to such fault conditions as detected, for example, by a trip unit. The electrical contact assemblies include stationary electrical contacts and corresponding movable electrical contacts that are separable from the stationary electrical contacts.

FIGS. 1A and 1B, for example, show a portion of a power air circuit breaker 1. The power air circuit breaker 1 uses opening springs 3 (one opening spring 3 is shown in simplified form in FIGS. 1 and 2) to achieve and maintain full opening gap (e.g., separation of the electrical contacts) during opening and, in some cases, to augment the opening speed to improve interruption. In order to minimize the required closing energy, the minimum possible opening spring force and energy is desired. Each opening spring 3 is attached at its moving end to an arm 5, which is fixed to the poleshaft 7. This arrangement stretches the spring 3 from open length, Lo (FIG. 1A) to closed length, Lc (FIG. 1B) as the poleshaft 7 rotates from open (FIG. 1A) to closed (FIG. 1B). The poleshaft 7 is commonly designed to maintain a substantially constant moment arm (see, for example, open moment arm, Mo of FIG. 1A and closed moment arm, Mc of FIG. 1B).

Achieving and maintaining full opening gap becomes especially difficult after interruption, when debris and shunt behavior cause the opening force requirement to increase. One option is to strengthen the opening springs. However, strengthening the opening springs without a corresponding increase in closing springs may lead to stalling and incomplete closures. Also, increased spring forces result in greater frictional forces that tend to resist desired movements of the circuit breaker. The difficulty of closing against stronger opening springs is more pronounced late in closing, once the moving contacts seat on the stationary contacts and the contact springs become a contributing factor. Increasing the closing springs to overcome stronger opening springs also adds cost, reduces life, and increases the requirements of some accessories such as, for example and without limitation, the closing solenoid and the charging motor. The foregoing difficulties become progressively more problematic as additional circuit breaker poles are added.

There is, therefore, room for improvement in electrical switching apparatus, such as circuit breakers, and in opening assemblies therefor.

SUMMARY

These needs and others are met by embodiments of the disclosed concept, which are directed to an opening assembly for electrical switching apparatus such as, for example and without limitation, circuit breakers. Among other benefits, the opening assembly arranges the opening springs in a manner which produces relatively large poleshaft torque at full open, to maintain open gap (e.g., separation of the electrical contacts), and substantially zero torque near the closed state, to ease the closing. Alternatively, the electrical switching apparatus can additionally include an engagement lug that causes, instead of substantially zero torque, the application of a torque at or near the closed state that is of a fixed and relatively small value.

As one aspect of the disclosed concept, an opening assembly is provided for an electrical switching apparatus. The electrical switching apparatus includes a housing, separable contacts enclosed by the housing, and an operating mechanism for opening and closing the separable contacts. The operating mechanism includes a poleshaft. The opening assembly comprises: a spring link comprising a first portion structured to be pivotably coupled to the poleshaft, and a second portion disposed generally opposite of the first portion, the spring link being movable between an open position and a closed position; and a number of opening springs each including a stationary end structured to be coupled to the housing, and a movable end coupled to the second portion of the spring link. When the spring link is disposed in the open position, the number of opening springs are structured to bias the spring link and the poleshaft to maintain full separation of the separable contacts. When the spring link is disposed in the closed position, the number of opening springs are structured not to bias the poleshaft or are alternatively structured to bias the poleshaft with a fixed, readily ascertainable, and relatively small torque.

The spring link may further comprise an intermediate portion extending between the first portion and the second portion. The intermediate portion may have an arcuate shape in order that, when the spring link is disposed in the closed position, the spring link is structured to extend around a portion of the poleshaft.

The poleshaft may include an arm extending outwardly therefrom. The first portion of the spring link may be structured to be pivotably coupled to the arm. The spring link may be formed from a pair of substantially identical planar members disposed opposite and spaced apart from one another, wherein a portion of the arm of the poleshaft is structured to be disposed between the pair of substantially identical planar members.

As another aspect of the disclosed concept, an electrical switching apparatus comprises: a housing; separable contacts enclosed by the housing; an operating mechanism for opening and closing the separable contacts, the operating mechanism including a pole shaft; and an opening assembly comprising: a spring link comprising a first portion pivotably coupled to the poleshaft, and a second portion disposed generally opposite of the first portion, the spring link being movable between an open position and a closed position, and a number of opening springs each including a stationary end coupled to the housing, and a movable end coupled to the second portion of the spring link. When the spring link is disposed in the open position, the number of opening springs bias the spring link and the poleshaft to maintain full separation of the separable contacts. When the spring link is disposed in the closed position, the number of opening springs do not to bias the poleshaft or are alternatively structured to bias the poleshaft with a fixed, readily ascertainable, and relatively small torque.

BRIEF DESCRIPTION OF THE DRAWINGS

A full understanding of the disclosed concept can be gained from the following description of the preferred embodiments when read in conjunction with the accompanying drawings in which.

Similar numerals refer to similar parts throughout the specification.

DESCRIPTION OF THE PREFERRED EMBODIMENTS

Figure 1B:
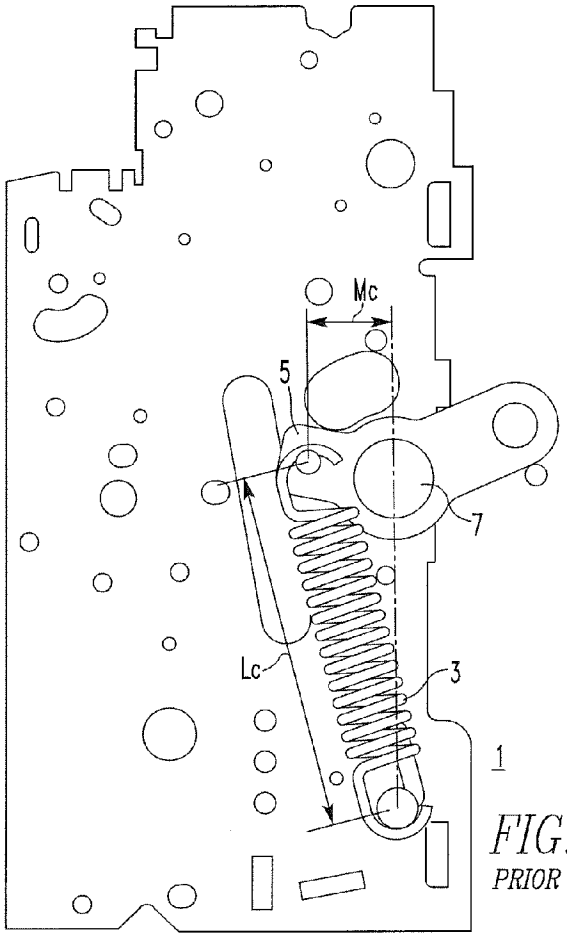
FIG.1B PRIOR ART
FIGS. 1A and 1B are side elevation views of portions of a known circuit breaker and opening assembly therefor, with FIG. 1A corresponding to the circuit breaker being open and FIG. 1B corresponding to the circuit breaker being closed.
Figure 1A:
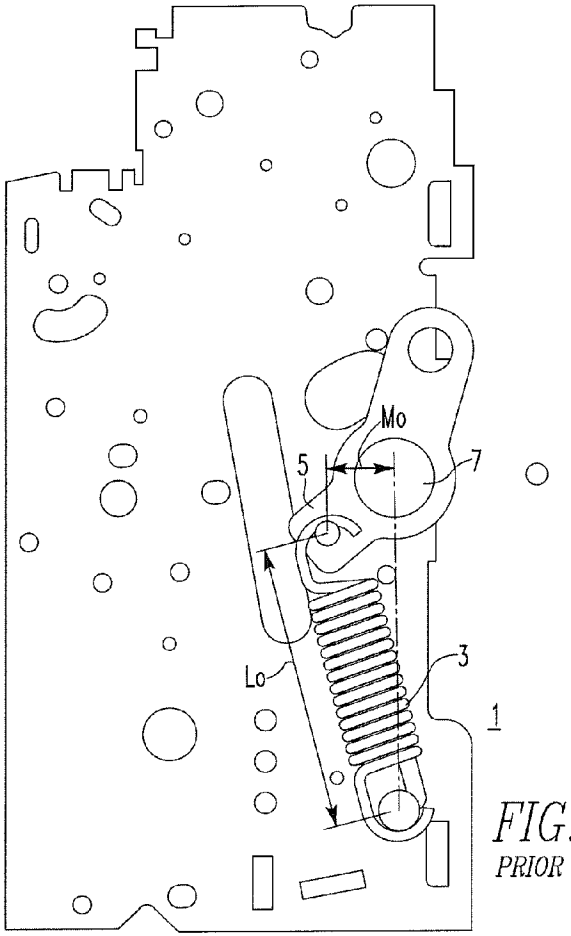
FIG.1A PRIOR ART

Directional phrases used herein, such as, for example, left, right, clockwise, counterclockwise and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
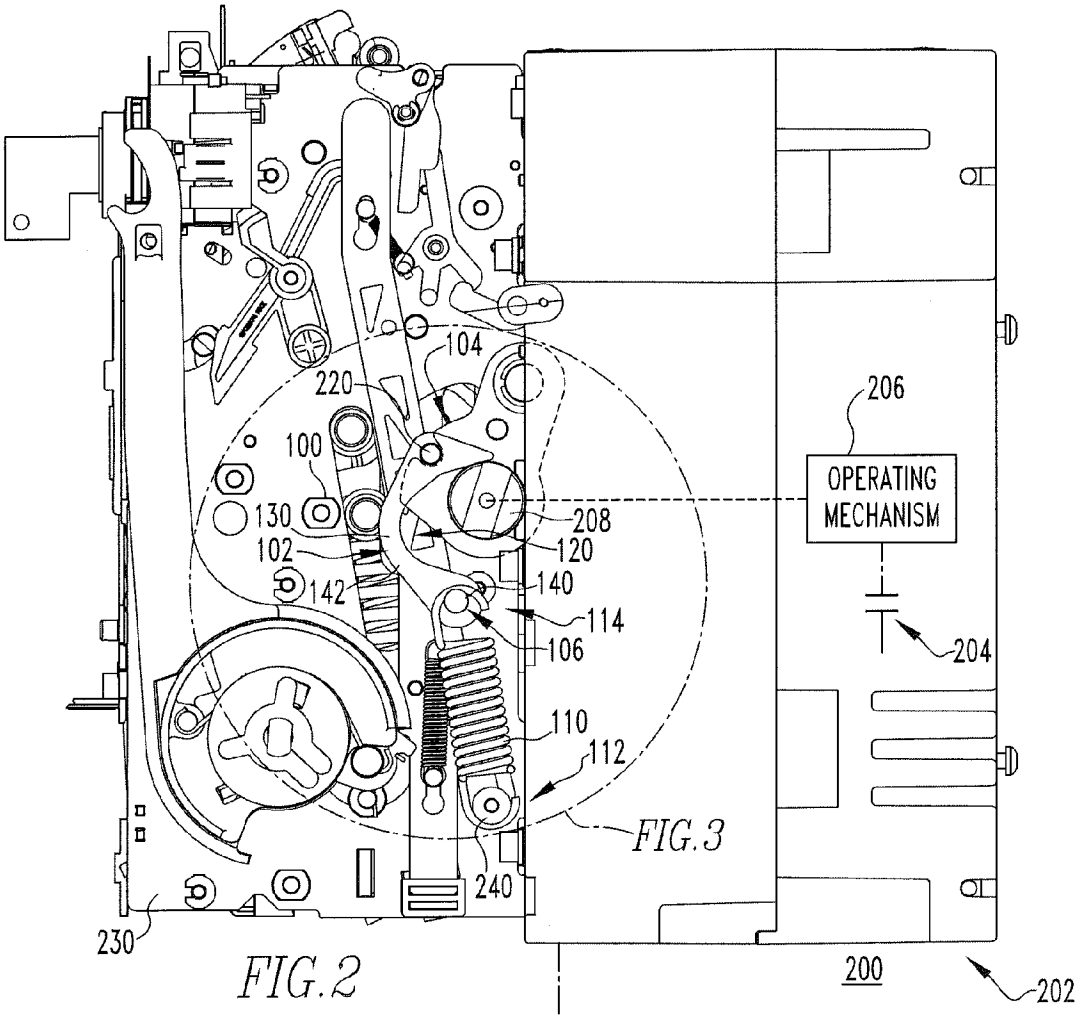
FIG. 2 is a side elevation view of a circuit breaker and opening assembly therefor, in accordance with a first embodiment of the disclosed concept.

FIG. 2 shows an opening assembly 100 for an electrical switching apparatus such as, for example and without limitation, a circuit breaker 200, both in accordance with a first embodiment of the disclosed and claimed concept. The circuit breaker 200 includes a housing 202, separable contacts 204 (shown in simplified form in FIG. 2) enclosed by the housing 202, and an operating mechanism 206 (shown in simplified form in FIG. 2) for opening and closing the separable contacts 204. The operating mechanism 206 includes a poleshaft 208 (best shown in the isometric view of FIG. 5).

Figure 4:
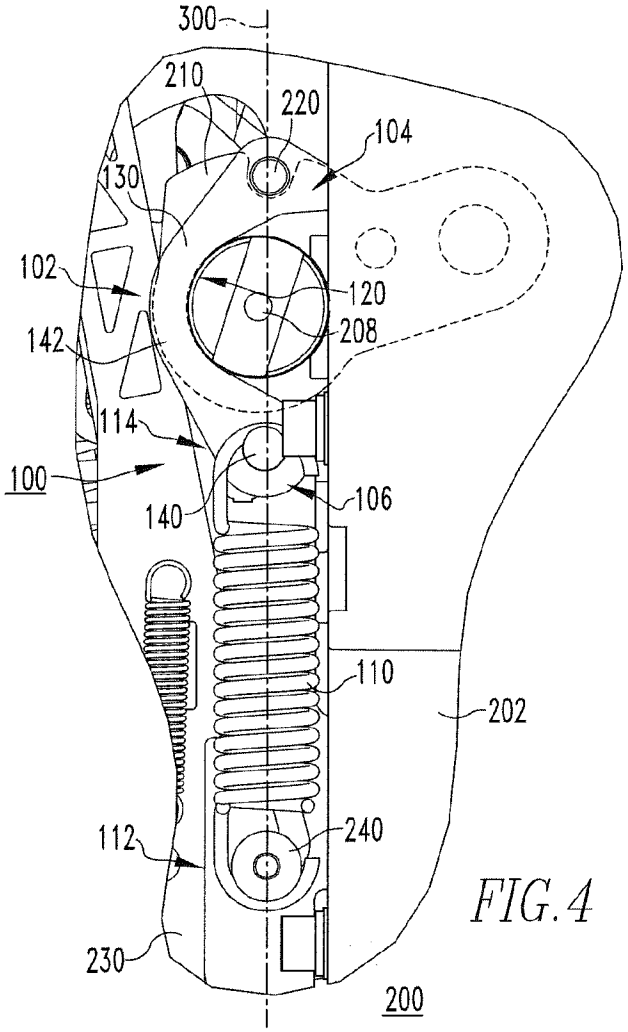
FIG. 4 is the enlarged view of FIG. 3, modified to show the opening assembly when the circuit breaker is closed.
Figure 3:
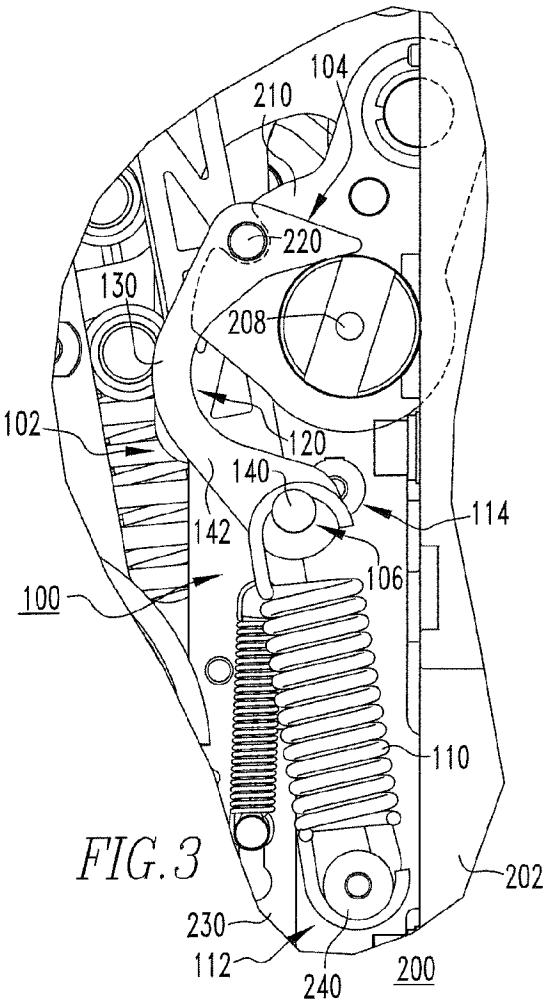
FIG. 3 is an enlarged view of the opening assembly of FIG. 2, shown as positioned when the circuit breaker is open.

The opening assembly 100 includes a spring link 102 having a first portion 104 structured to be pivotably coupled to the poleshaft 208, and a second portion 106 disposed generally opposite the first portion 104. The spring link 102 is movable between an open position (FIGS. 2, 3, 5 and 6A) and a closed position (FIGS. 4 and 6B). The opening assembly 100 further includes a number of opening springs 110 each including a stationary end 112 coupled to the circuit breaker housing 202, and a movable end 114 coupled to the second portion 106 of the aforementioned spring link 102.

In view of the foregoing structure, when the spring link 102 is disposed in the open position, shown in FIGS. 2, 3, 5 and 6A, the opening spring(s) 110 is/are structured to bias the spring link 102 and the poleshaft 208 (e.g., counterclockwise from the perspective of FIG. 2) to maintain full separation of the separable contacts 204 (FIG. 2). In other words, the disclosed concept arranges the opening springs 110 and their attachment to the poleshaft 208, via the spring link 102, in a manner to produce relatively large poleshaft torque at full open (e.g., without limitation, to maintain open gap between the separable contacts 204 (FIG. 2)). Additionally, when the spring link 102 is disposed in the closed position of FIGS. 4 and 6B, the opening spring(s) 110 is/are structured not to bias the poleshaft 208. In other words, substantially zero torque is applied by the opening spring(s) 110 in the closed state, thereby reducing the required closing energy and associated stress on circuit breaker components. Furthermore, the reduced requirement for closing springs allows for a reduction in closing energy or increased closing margins. Reduced closing energy advantageously reduces the requirements on accessories (e.g., without limitation, spring release; motor operator) and increases lifespan. Increased closing margins accommodate changes and circuit breaker performance after interruption, without the need for increased closing speeds and/or reduced contact springs. The specific manner in which the disclosed opening assembly 100 achieves these benefits will be described in greater detail hereinbelow.

Continuing to refer to FIG. 2, and also to FIGS. 3-6B, the spring link 102 of the disclosed opening assembly 100 further includes an intermediate portion 120, which extends between the first and second portions 104,106 and preferably has an arcuate shape. Such arcuate shape enables the spring link 102 to extend around a portion of the circuit breaker poleshaft 208 when the spring link 102 is disposed in a closed position, shown in FIGS. 4 and 6B. As best shown in the isometric view of FIG. 5, the poleshaft 208 preferably includes an arm 210, which extends outwardly from the poleshaft 208. The first portion 104 of the spring link 102 is structured to be pivotably coupled to the arm 210. In the example shown and described herein, the spring link 102 is formed from a pair of substantially identical planar members 130,132, which are disposed opposite and spaced apart from one another. Accordingly, a portion of the arm 210 of the poleshaft 208 is disposed between the pair of substantially identical planar members 130,132, as shown. The poleshaft 208 further includes a pivot pin 220, which pivotably couples the spring link 102 to the poleshaft arm 210.

Figure 5:
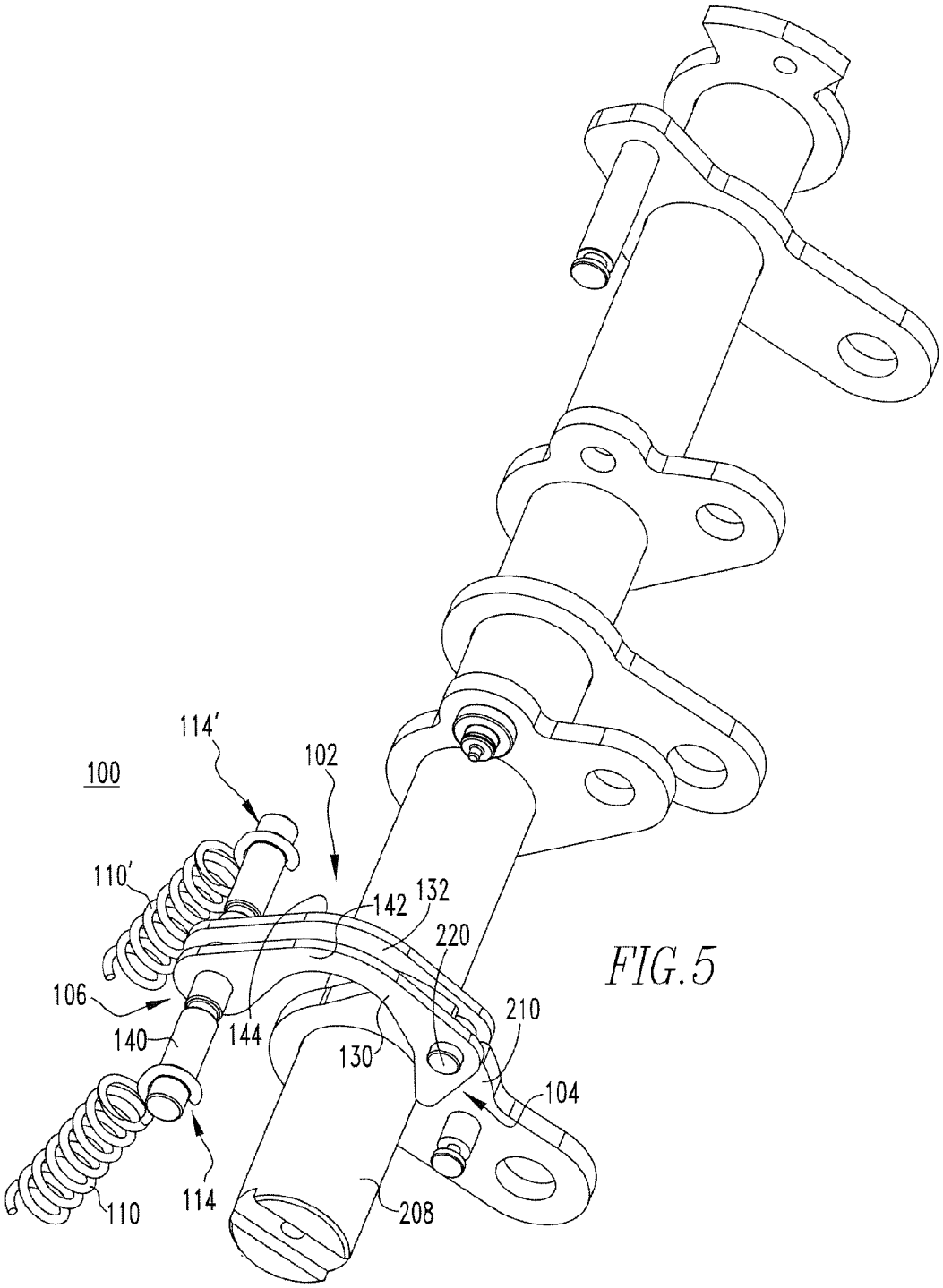
FIG. 5 is an isometric view of a portion of the opening assembly of FIG. 4.
Figure 6B:
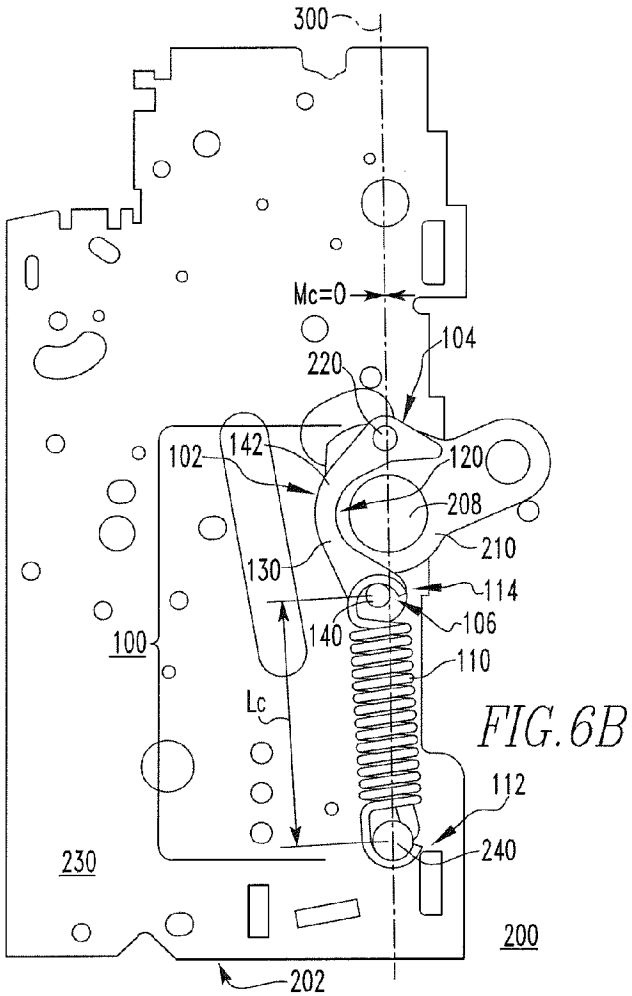
FIGS. 6A and 6B are side elevation views of portions of the circuit breaker and opening assembly therefor, in accordance with an embodiment of the disclosed concept, with FIG. 6A corresponding to the circuit breaker being open and FIG. 6B corresponding to the circuit breaker being closed.

Continuing to refer to FIG. 5, the spring link 102 of the opening assembly 100 further includes a projection 140 extending laterally outwardly from the second portion 106 of the spring link 102. In the example of FIG. 5, the projection is a pin 140, which extends laterally outwardly from the first side 142 of the spring link 102, in a first direction, and laterally outwardly from the second side 144 of the spring link 102, in a second direction opposite the first direction. As partially shown in the example of FIG. 5, more than one opening spring may be employed, without departing from the scope of the disclosed concept. For example, a first opening spring 110 includes a movable end 114 coupled to the pin 140 on the first side 142 of the spring link 102, and a second opening spring 110' includes a movable end 114', which is coupled to the pin 140 on the second side 144 of the spring link 102. It will, however, be appreciated that any known or suitable alternative number, type and/or configuration of spring links (e.g., 102) and/or opening springs (e.g., without limitation 110,110') could be employed. For economy of disclosure and ease of illustration, only one opening assembly 100 and spring link 102 therefor, is described in detail herein.

Figure 6A:
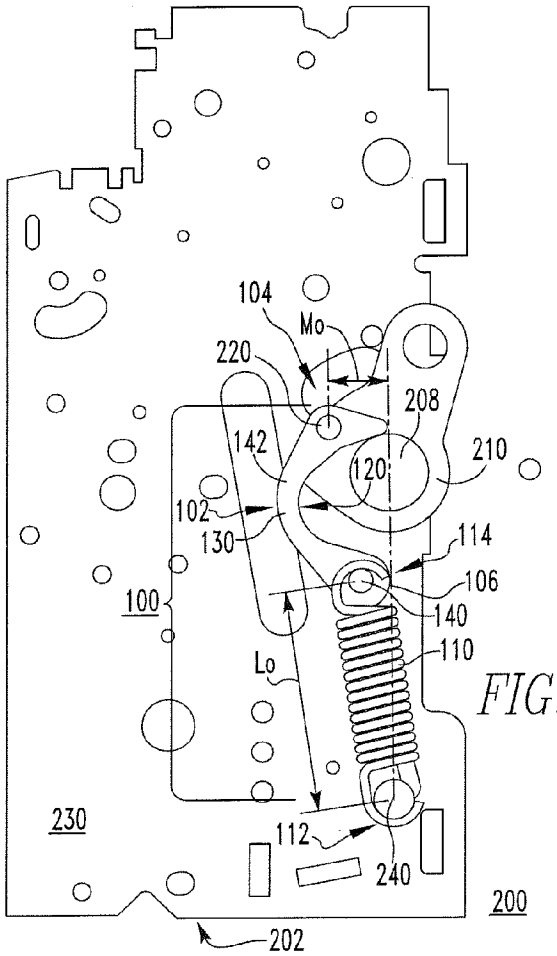
Figure 7:
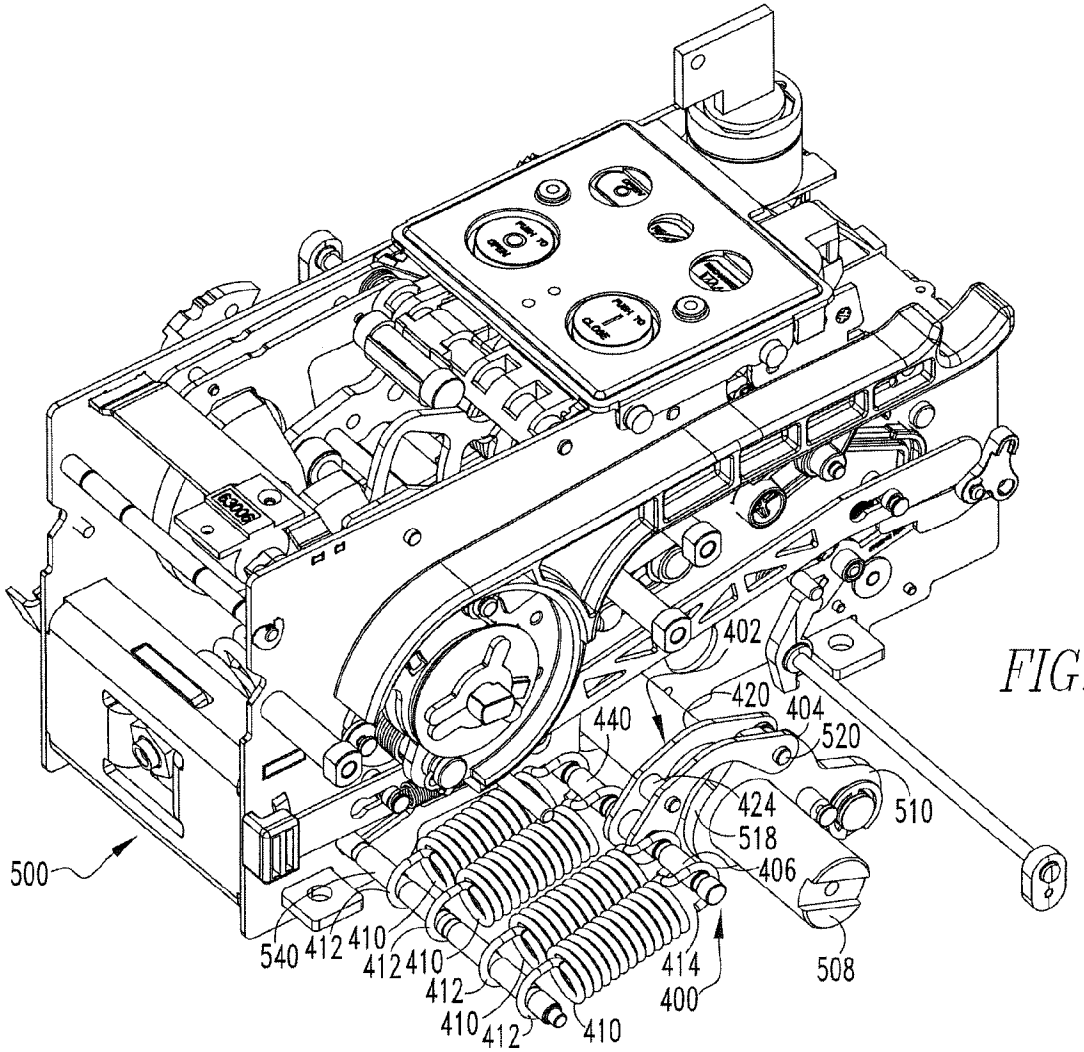
FIG. 7 is a perspective view of an improved circuit breaker and an opening assembly therefor in an OPEN condition in accordance with a second embodiment of the disclosed and claimed concept.
Figure 8:
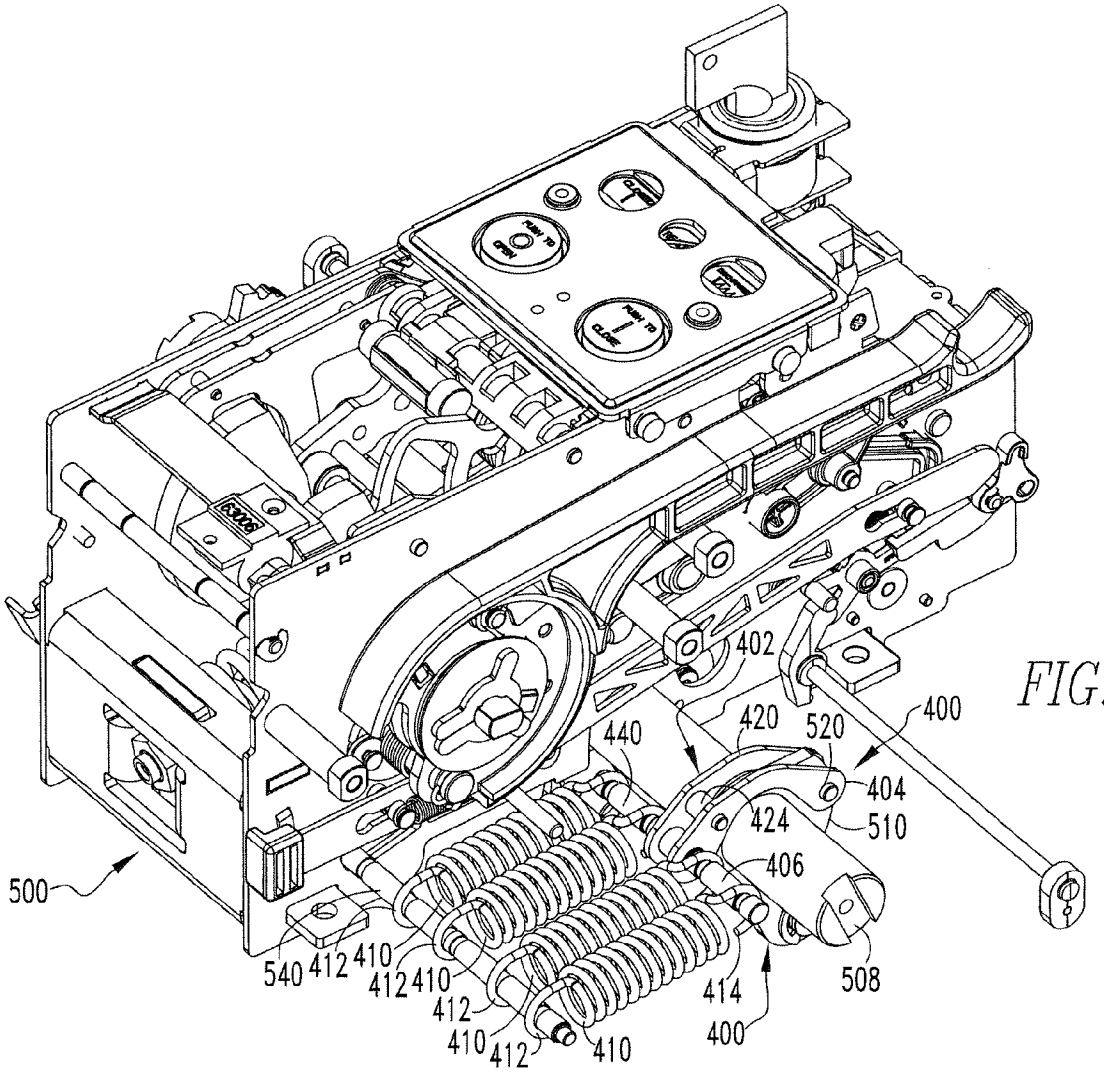
FIG. 8 is a view of the circuit breaker and opening assembly of FIG. 7, except depicting the circuit breaker in a CLOSED condition.

As shown in FIGS. 6A and 6B, the housing 202 of the example circuit breaker 200 includes a side plate 230 and at least one protrusion 240, which extends outwardly from the side plate 230, as shown. The stationary end 110 of each of the number of opening springs (e.g., 110) is coupled to a corresponding one of the at least one protrusions 240.

As shown in FIGS. 4 and 6B, in operation, when the spring link 102 is disposed in a closed position, the first portion 104 and the second portion 106 are generally disposed on opposite sides of the poleshaft 208, as shown. It will be appreciated that this results in the pivot pin 220, the poleshaft 208, and the opening spring(s) 110 being substantially aligned along an axis 300. As shown, opening spring(s) 110, pin 140, poleshaft 208, pivot pin 220, and protrusion 240 are generally all aligned with axis 300. Accordingly, it will be appreciated that such alignment correspondingly results in substantially zero moment arm (see, for example, moment arm Mc=0 in FIG. 6B). In other words, substantially zero torque is applied by the opening spring(s) 110 to the spring link 102 or poleshaft 208, in the closed position, thereby reducing requirements for the closing springs and allowing a reduction in closing energy, as well as increased closing margins, as previously discussed hereinabove.

It will also be appreciated that the spring link 102 design of the disclosed opening assembly 100 achieves a moment arm, Mo, as desired, when the spring link 102 is disposed in the open position of FIG. 6A. As shown by comparing FIG. 6A to FIG. 6B, it will be appreciated that the opening spring length Lo, when the spring link 102 is in the open position of FIG. 6A, is relatively similar to the closed spring length Lc, when the spring link 102 is disposed in the closed position of FIG. 6B. This, in combination with the aforementioned closing moment arm, Mc being substantially zero (see FIG. 6B), have profound beneficial effects on the circuit breaker's operation. For example, the disclosed opening assembly 100 consumes less than 40 percent of the energy of conventional closing spring designs. Furthermore, the opening assembly 100 is capable of producing about 20 percent more poleshaft torque at full open and still consuming less of about half of the energy of conventional designs.

Accordingly, among other benefits, the disclosed opening assembly 100 provides a unique spring link 102 and opening spring 110 arrangement, which effectively functions to produce desired poleshaft torque at full open (e.g., without limitation, to maintain open gap between separable contacts 204 (FIG. 2)) and substantially zero torque in the closed state, thereby reducing the required closing energy and associated stress.

An improved opening assembly 400 and an improved circuit breaker 500 of which the opening assembly 400 is a part are depicted generally in FIGS. 7-11, both being in accordance with a second embodiment of the disclosed and claimed concept. As will be set forth in greater detail below, the opening assembly 400 and circuit breaker 500 are substantially similar to the opening assembly 100 and the circuit breaker 200, except that the opening assembly 400 is configured to apply a non-zero torque to a poleshaft 508 when the circuit breaker 500 is in a CLOSED condition.

The opening assembly 400 can be said to include a spring link 402 that includes a first portion 404 and a second portion 406 that are opposite one another. The opening assembly 400 further includes a set of opening springs 410, each of which has a stationary end 412 that is coupled with the circuit breaker 500 and a movable end 414 opposite thereto that is coupled with the second portion 406. More particularly, the spring link 402 further includes a projection 440 mounted on the second portion 406, and the movable ends 414 are situated on the projection 440. The projection 440 is a pin that extends laterally outwardly in a first direction from a first side of the spring link 402, and that extends laterally outwardly in a second direction from a second side of the spring link 402. The first and second directions are opposite one another. The spring link 412 further includes an intermediate portion 420 that extends between the first and second portions 404 and 406. All of this is similar to the opening assembly 100.

However, the spring link 402 of the opening assembly 400 further includes an engagement lug 424 that is situated on the intermediate portion 420 at a location relatively closer to the second portion 406 than to the first portion 404. At a transitional position situated generally between the OPEN and CLOSED conditions of the circuit breaker 500, the engagement lug 424 is engageable with the poleshaft 508 and advantageously alters the kinematic relationship among the opening springs 410, the spring link 402, and the poleshaft 508. This can be desirable in certain circumstances.

The poleshaft 508 has an arm 510 formed thereon that protrudes outwardly therefrom. The arm 510 includes a flange 518 that is of a partially annular shape and that protrudes radially outwardly from the poleshaft 508. When the circuit breaker 500 is in the transitional position, as is depicted generally in FIG. 10, the torque applied by the opening springs 410 on the poleshaft 508 is generally at a minimum. However, the engagement lug 424 engages the flange 518 at the transitional position, and further movement of the circuit breaker 500 from the transitional position of FIG. 10 toward the CLOSED position of FIGS. 8 and 11 results in an increase in the torque applied by the opening springs 410 on the poleshaft 508.

Figure 9:
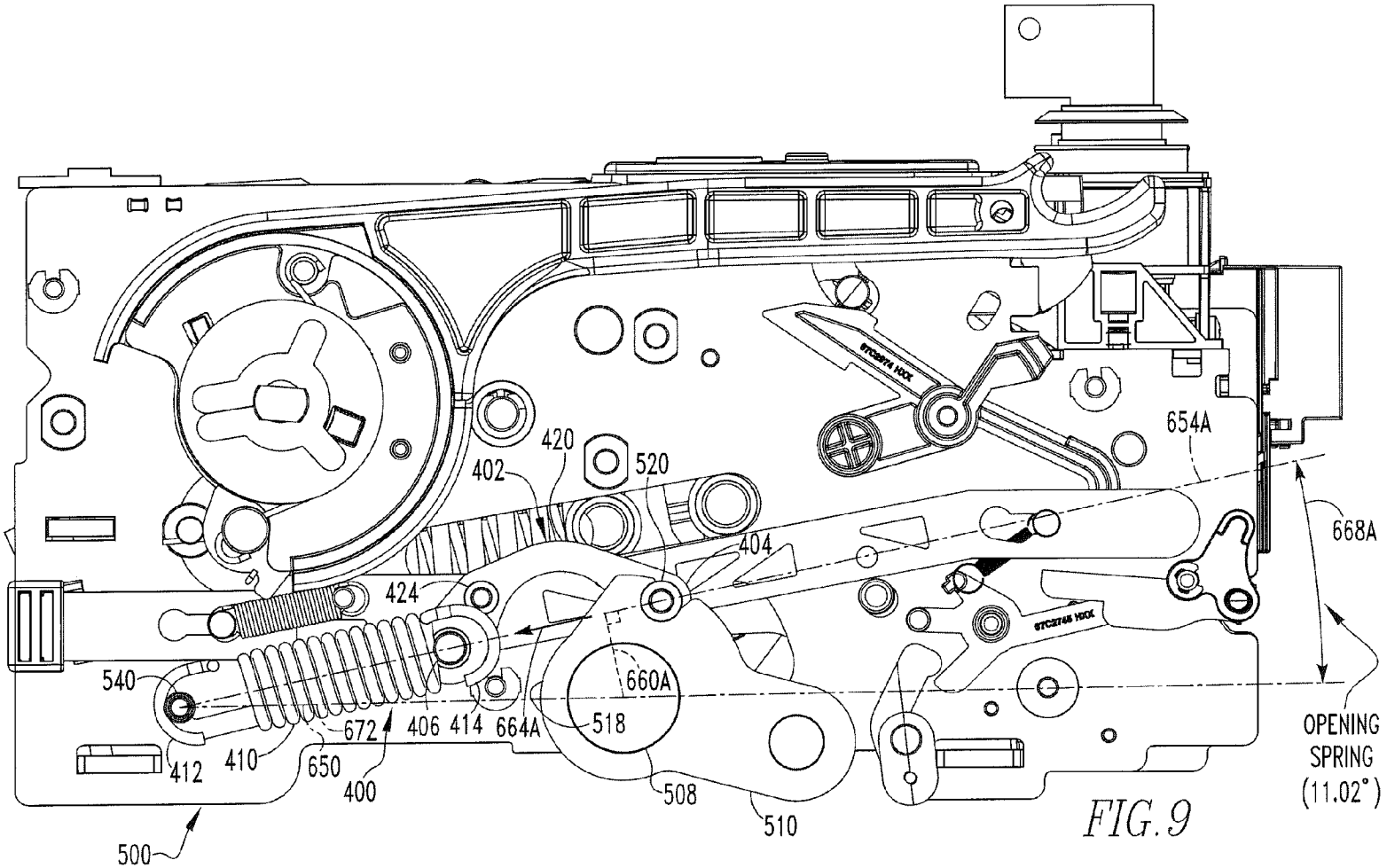
FIG. 9 is a side elevational view of the circuit breaker of FIG. 7.

More particularly, and as can be seen in FIG. 9, a pivot pin 520 on the first portion 404 is pivotably mounted to the flange 518 and thus pivotably couples the spring link 402 to the poleshaft 508. The tension of the opening springs 410 is applied to the poleshaft 508 in the OPEN configuration of the circuit breaker 500 of FIGS. 7 and 9. The stationary ends 412 of the opening springs 410 are coupled with a protrusion 540 on the circuit breaker 500. Since the second portion 406 of the spring link 402 and the movable ends 414 of the opening springs 410 that are connected therewith are generally unconstrained in the OPEN state, it can be seen that the protrusion 540, the second portion 406, and the pivot pin 520 all lie along an axis of force 654A of the opening springs 410. That is, since the second portion 406 and the movable ends 414 of the opening springs 410, while being coupled together, are otherwise generally freely movable in pivoting motion about the pivot pin 520, the tension in the opening springs 410 causes the second portion 406 to be aligned along an axis that extends between the protrusion 540 and the pivot pin 520, which is the axis of force 654A. A tensile force of the opening springs 410 in the OPEN condition of the circuit breaker 500 is applied at a given distance from the rotational axis of the poleshaft 508, with the given distance in the OPEN state being indicated by a moment arm 660A. Such tensile force of the opening springs 410 along the axis of force 654A that is applied at a distance from the axis of rotation of the poleshaft 508 that is characterized by the moment arm 660A results in a torque 664A that is applied to the poleshaft 508.

Figure 10:
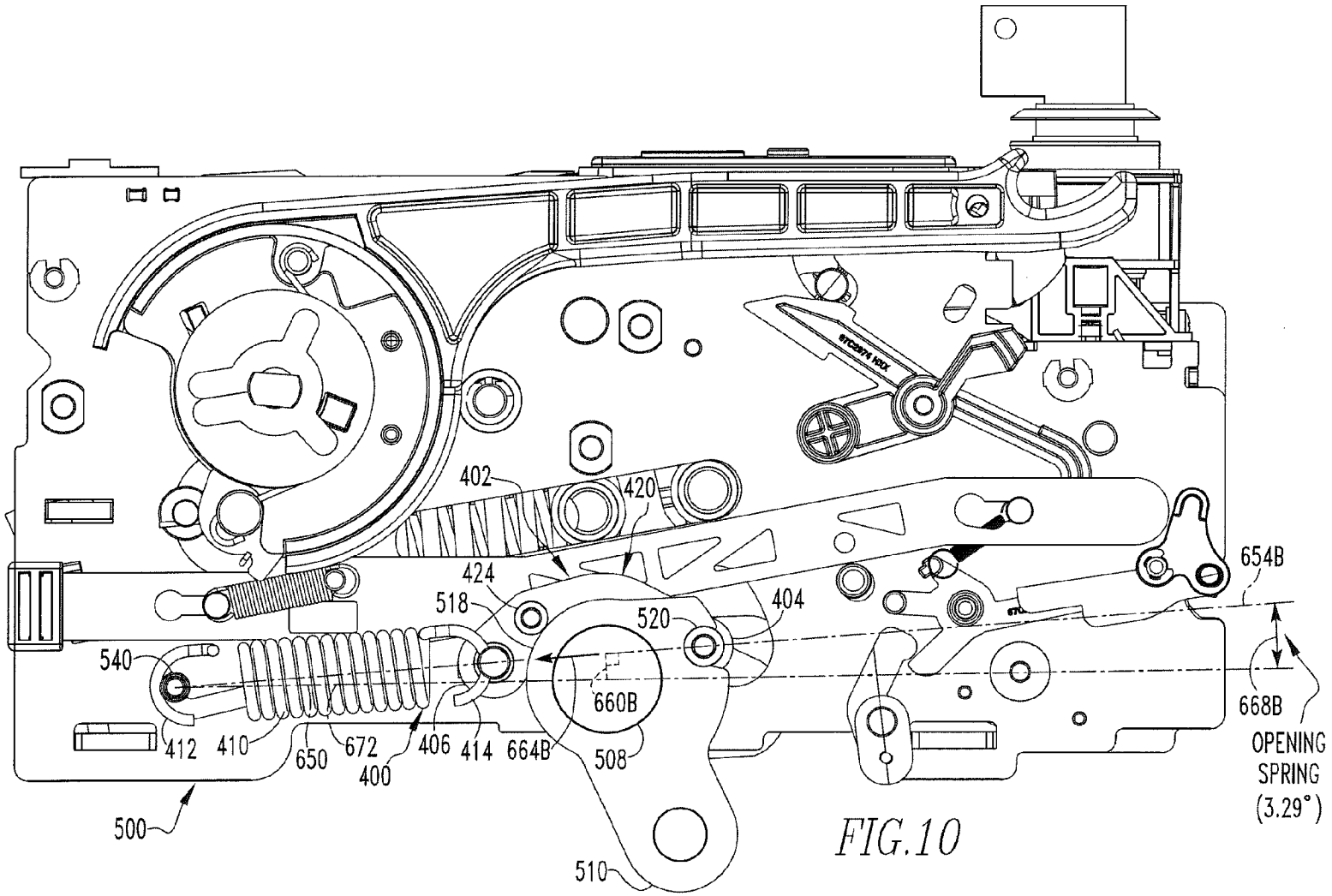
FIG. 10 is a view similar to FIG. 9, except depicting the circuit breaker in a partially CLOSED state at a point at which a moment arm or engagement lug is touching a flange on the poleshaft.

As the poleshaft 508 rotates from the OPEN condition in the clockwise direction (from the perspective of FIGS. 9-11) toward the transitional position of the circuit interrupter 500 (which is depicted in FIG. 10), the movement of the pivot pin 520 results in the pivot pin 520, the protrusion 540, and the second portion 406 remaining aligned with one another along another axis of force 654B. In the transitional position, the tensile force of the opening springs 410 is applied to the poleshaft 508 at a moment arm 660B that is relatively shorter than the moment aim 660A. That is, in the OPEN condition of the circuit breaker 500 of FIG. 9, the axis of force 654A is at a first angle of force 668A with respect to a segment 672 that can be said to extend between the rotational axis of the poleshaft 508 and the location on the protrusion 540 that is contacted by the opening springs 410. Such segment 672 is generally of a distance 650 that can either be considered to be unvarying or that can be easily calculated based upon the position of the stationary ends 412 of the opening springs 410 on the protrusion 540 at any given position of the circuit breaker 500 between the OPEN and CLOSED conditions. Since the angle of force 668A and the distance 650 are both either known or knowable, a length of the moment arm 660A can be calculated. When the dimension of the moment arm 660A is combined with the tension in the opening springs 410 which is applied at that distance from the rotational axis of the poleshaft 508, the torque 664A can be calculated. Likewise, the torque 664B can be calculated for the moment arm 660B and an angle of force 668B at the transitional position, with the resultant torque 664B being of a relatively lesser magnitude than the torque 664A.

Figure 11:
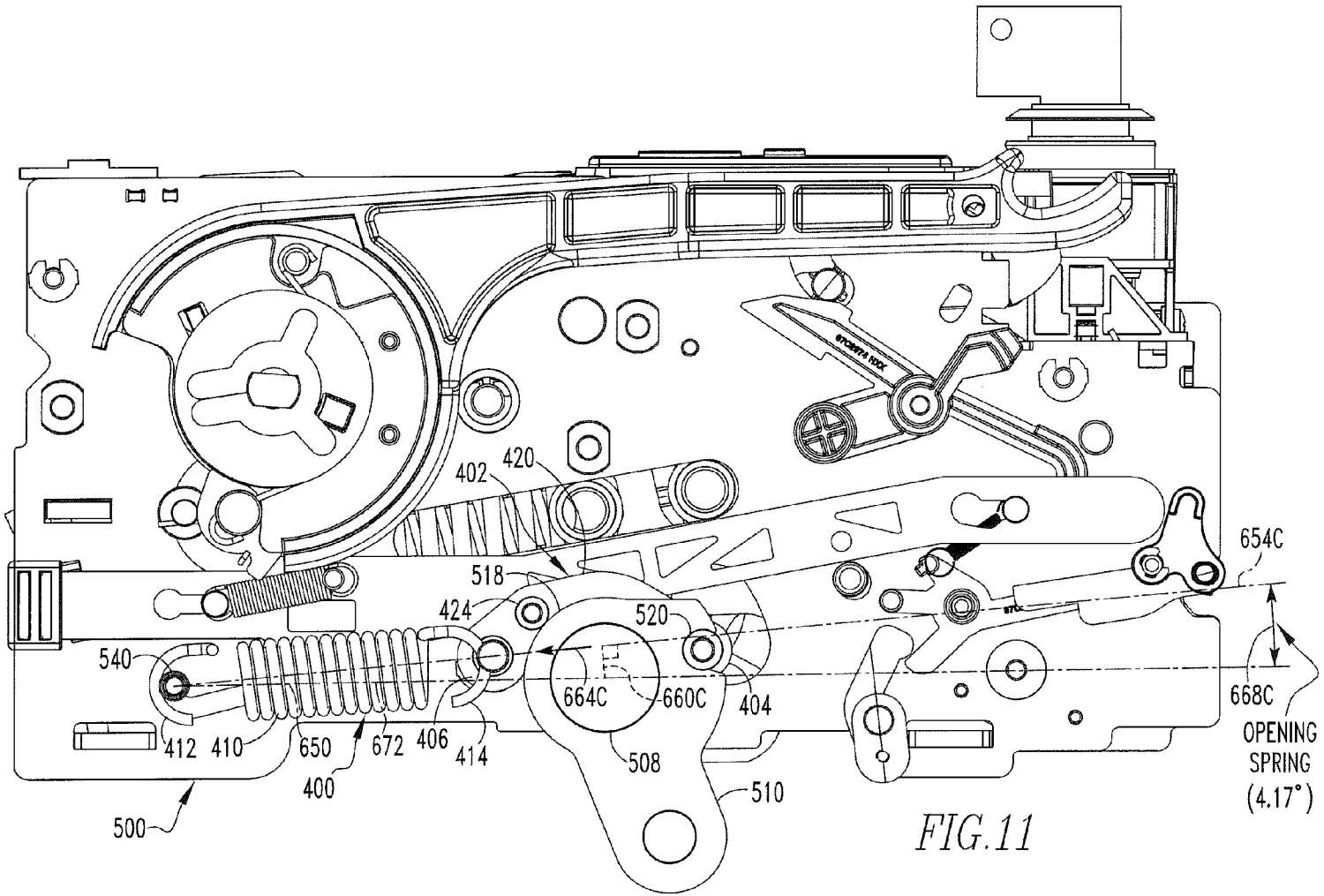
FIG. 11 is a view similar to FIG. 10, except depicting the circuit breaker in a CLOSED condition.

It is noted, however, that when the poleshaft 508 is rotated from the transitional position of FIG. 10 toward the CLOSED condition of FIG. 11, the engagement of the engagement lug 424 with the flange 518 causes the second portion 404 to pivot slightly away from the segment 672. That is, in the CLOSED condition of FIG. 11, the opening springs 410 exert a tensile force along an axis of force 654C that extends along an axis that includes the second portion 406 and the protrusion 540, but which is spaced from the pivot pin 520. The axis of force 654C results in a different angle of force 668C and a resultant moment arm 660C that is relatively greater than the moment arm 660B. Since the moment arm 660C is relatively greater than the moment arm 660B, and since the opening springs 410 exert a greater tensile force in the CLOSED condition of FIG. 11 than in the transitional position of FIG. 10, the resultant torque 664C applied to the poleshaft 508 in the CLOSED condition of the circuit breaker 500 is relatively greater than the torque 664B applied to the poleshaft 508 in the transitional position of FIG. 10. That is, when the engagement lug 424 engages the flange 518 of the poleshaft 508 at the transitional position, and with continued rotation of the poleshaft 508 from the transitional position toward the CLOSED condition of the circuit breaker 500, the second portion 406 and the movable ends 414 of the opening springs 410 have movement that is no longer freely movable and rather is constrained by the engagement of the pivot pin 520 and the engagement lug 424 with the arm 510 and the flange 518, and due to the tension applied to the spring link 402 by the opening springs 410.

The engagement of the engagement lug 424 with the flange 518 of the poleshaft 508 thus constrains the second portion 406 and the movable ends 414 such that their point of conjunction can be said to rotate at a fixed distance from the axis of rotation of the poleshaft 508 when the poleshaft 508 moves between the transitional position and the CLOSED condition of the circuit breaker. Such motion has the effect of changing the moment arm between the values depicted with the moment arms 660B and 660C. This results in a residual torque 664C being applied to the poleshaft 508 by the opening springs 410 in the CLOSED position of the circuit breaker 500 that is depicted generally in FIGS. 8 and 11. The torque 664C is advantageously configured such that it overcomes the static and dynamic friction that can be said to exist between the poleshaft 508 and the other components of the circuit breaker 500, whereby the torque 664C is sufficient to initiate movement of the poleshaft 508 away from the CLOSED position of the circuit breaker 500 and toward the OPEN condition of the circuit breaker 500.

Such relatively increased torque 664C (as compared with the torque 664B) in the CLOSED condition of the circuit breaker 500 advantageously minimizes any hesitation due to friction that might otherwise hamper a rapid movement of the circuit breaker 500 away from the CLOSED position. The residual torque 664C that results from engagement of the engagement lug 424 with the flange 528 of the poleshaft 508 additionally results in a relatively ascertainable value for the torque 664C, which overcomes or at least ameliorates the effects of dimensional tolerances within the components from which the circuit breaker 500 is manufactured. That is, if the circuit breaker 500 is configured to have essentially zero torque at its CLOSED positions, variations in tolerance of the components of the circuit breaker 500 could result in a slight torque being applied to the poleshaft 508 in either the clockwise or the counter-clockwise directions from the perspective of FIG. 11. While such a torque would still be very small, its magnitude in comparison with zero torque can be significant. However, by configuring the circuit breaker 500 to advantageously have the torque 664C at its CLOSED condition with the torque 664C being readily ascertainable (based on the foregoing), any slight variations in the magnitude of the actual torque applied to the poleshaft 508 at the CLOSED condition of the circuit breaker 500 would likely be relatively insignificant in comparison with the magnitude of the torque 664C. Stated otherwise, a slight torque that can result from variations in tolerance may be significant in comparison with zero torque but is of relatively less significance when compared with a nominal non-zero level of torque. As such, the provision of the torque 664C in the CLOSED condition of the circuit breaker 500 improves the reliability of its function, which is desirable.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An opening assembly for an electrical switching apparatus, the electrical switching apparatus including a housing, a set of separable contacts enclosed by the housing, and an operating mechanism structured to move the separable contacts between and OPEN condition and a CLOSED condition, the operating mechanism including a poleshaft, said opening assembly comprising:

a spring link comprising a first portion structured to be pivotably coupled to said poleshaft, and a second portion disposed generally opposite of the first portion, the spring link being movable between an open position and a closed position; and a number of opening springs each including a stationary end structured to be coupled to the housing, and a movable end coupled to the second portion of said spring link, wherein in the OPEN condition the number of opening springs and the spring link are structured to apply a first torque to bias the poleshaft to maintain full separation of said separable contacts, wherein in a transitional position situated between the OPEN and CLOSED conditions the number of opening springs and the spring link are structured to bias the poleshaft at an intermediate torque that is less than the first torque in magnitude, and wherein in the closed position of the spring link the number of opening springs are structured to bias the poleshaft with another torque that is greater than the intermediate torque but less than the first torque.

2. The opening assembly of claim 1 wherein said spring link further comprises an intermediate portion that extends between the first portion and the second portion and further comprises an engagement lug disposed on the intermediate portion; wherein in the transitional position the engagement lug is structured to engage the poleshaft; and wherein the engagement lug engaged with the poleshaft is structured to increase a moment arm of a tensile force of the number of opening springs applied to the poleshaft.

3. An electrical switching apparatus comprising:

a housing;

separable contacts enclosed by the housing;

an operating mechanism for opening and closing said separable contacts, said operating mechanism including a pole shaft; and the opening assembly of claim 1.

4. The opening assembly of claim 1 wherein said poleshaft includes an arm extending outwardly therefrom; and wherein the first portion of said spring link is structured to be pivotably coupled to said arm.

5. The opening assembly of claim 4 wherein said spring link is formed from a pair of substantially identical planar members disposed opposite and spaced apart from one another; and wherein a portion of said arm of said poleshaft is structured to be disposed between said pair of substantially identical planar members.

6. The opening assembly of claim 4 wherein said poleshaft further includes a pivot pin; and wherein the first portion of said spring link is structured to be pivotably coupled to said arm of said poleshaft by said pivot pin.

7. The opening assembly of claim 6 wherein said spring link further comprises a projection extending laterally outwardly from the second portion of said spring link; and wherein the movable end of each of said number of springs is coupled to said projection.

8. The opening assembly of claim 7 wherein said spring link further comprises a first side and a second side; wherein said projection is a pin; and wherein said pin extends laterally outwardly from the first side of said spring link in a first direction and laterally outwardly from the second side of said spring link in a second direction opposite the first direction.

9. The opening assembly of claim 8 wherein said number of opening springs comprises a first opening spring and a second opening spring; wherein the movable end of said first opening spring is coupled to said pin on the first side of said spring link; and wherein the movable end of said second opening spring is coupled to said pin on the second side of said spring link.

10. The opening assembly of claim 8 wherein the housing of said electrical switching apparatus includes a side plate and at least one protrusion extending outwardly from said side plate; and wherein the stationary end of each of said number of opening springs is structured to be coupled to a corresponding one of said at least one protrusion.

11. The opening assembly of claim 10 wherein, when said spring link is disposed in said closed position, the first portion and the second portion are structured to be disposed on opposite sides of said poleshaft and said pivot pin, said poleshaft, and said number of opening springs are substantially aligned.

* * * * *